United States Patent [19]

DeWitt, Jr.

[11] 4,176,843

[45] Dec. 4, 1979

[54] AERODYNAMIC THROWING DISC

[76] Inventor: Leslie DeWitt, Jr., 9820 Rush St., S. El Monte, Calif. 91733

[21] Appl. No.: 868,476

[22] Filed: Jan. 11, 1978

Related U.S. Application Data

[63] Continuation of Ser. No. 745,871, Nov. 29, 1976, abandoned.

[51] Int. Cl.[2] ..... A63H 27/00

[52] U.S. Cl. ..... 273/106 B; 46/74 D; 40/324; 40/327

[58] Field of Search ..... 273/106 R, 106 B, 105.4; 46/74 D; 40/327, 324

[56] References Cited

U.S. PATENT DOCUMENTS

| | | | |
|---|---|---|---|
| 1,404,132 | 1/1922 | Manes | 273/106 B |
| 3,185,480 | 5/1965 | Weyman et al. | 273/106 B X |
| 3,720,018 | 3/1973 | Peterson et al. | 46/74 D X |
| 3,724,122 | 4/1973 | Gillespie | 273/106 B X |
| 3,900,986 | 8/1975 | Torres | 46/74 D |

FOREIGN PATENT DOCUMENTS

| | | | |
|---|---|---|---|
| 11201 | of 1907 | United Kingdom | 273/105.4 |

*Primary Examiner*—Paul E. Shapiro
*Attorney, Agent, or Firm*—Boniard I. Brown

[57] ABSTRACT

An improved two piece aerodynamic throwing disc, commonly known as a flying saucer or Frisbee, having a central wall portion or insert positioned within an opening through and perimetrically secured to an outer annular rim portion. This two piece construction facilitates embossing and/or imprinting of the disc with a design, lettering or the like and provides the disc with improved gyroscopic stability and overall flight characteristics.

4 Claims, 9 Drawing Figures

FIG. 1.
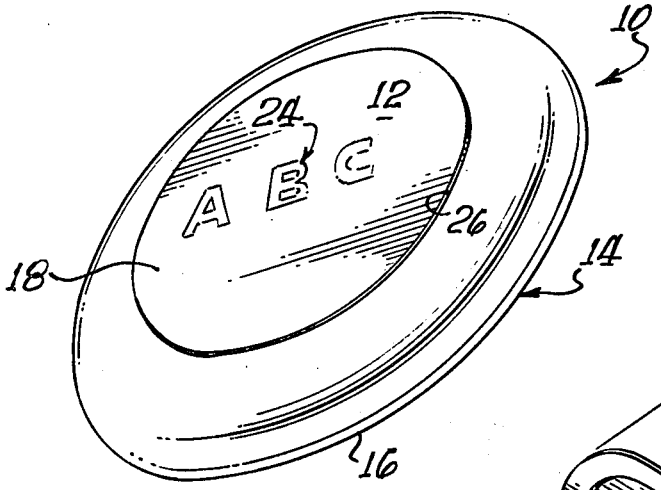
FIG. 2.
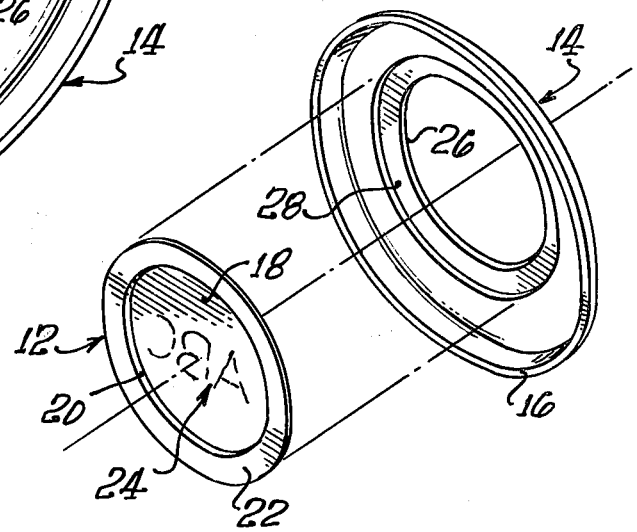
FIG. 3.
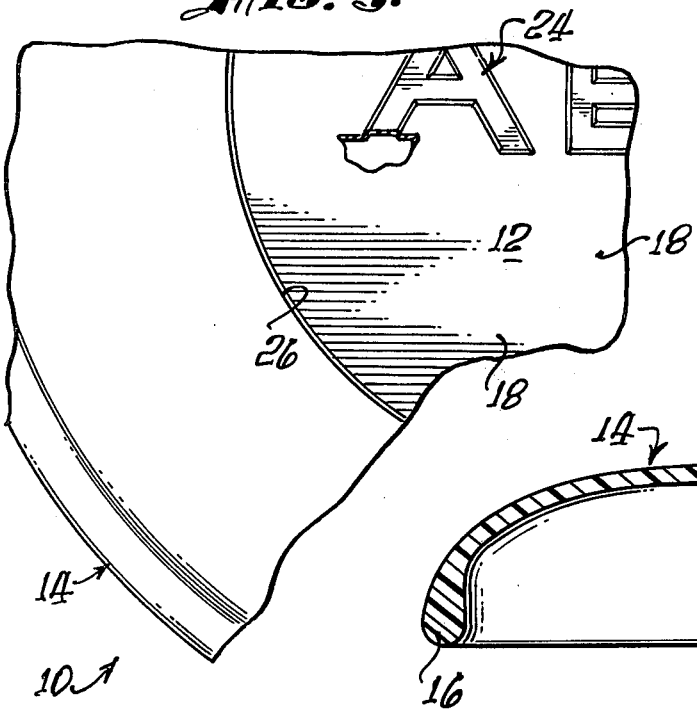
FIG. 4a.
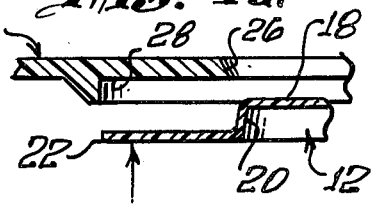
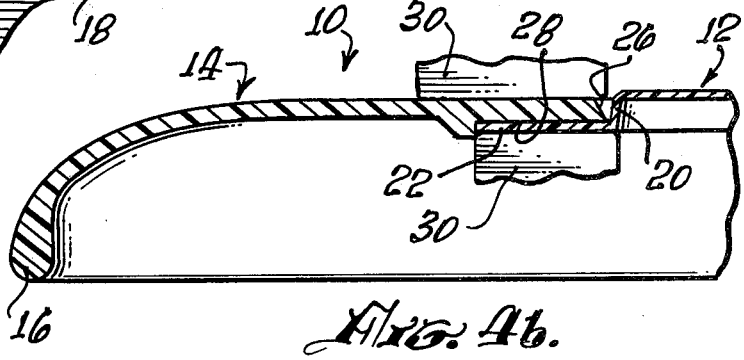
FIG. 4b.

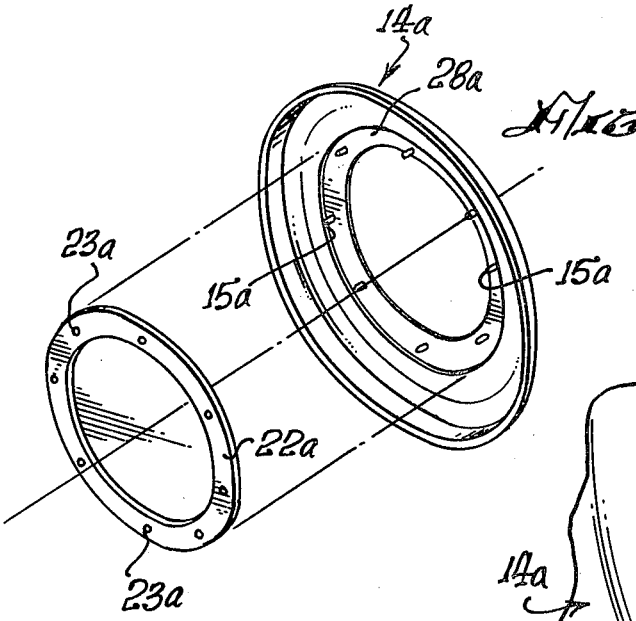
FIG. 5.
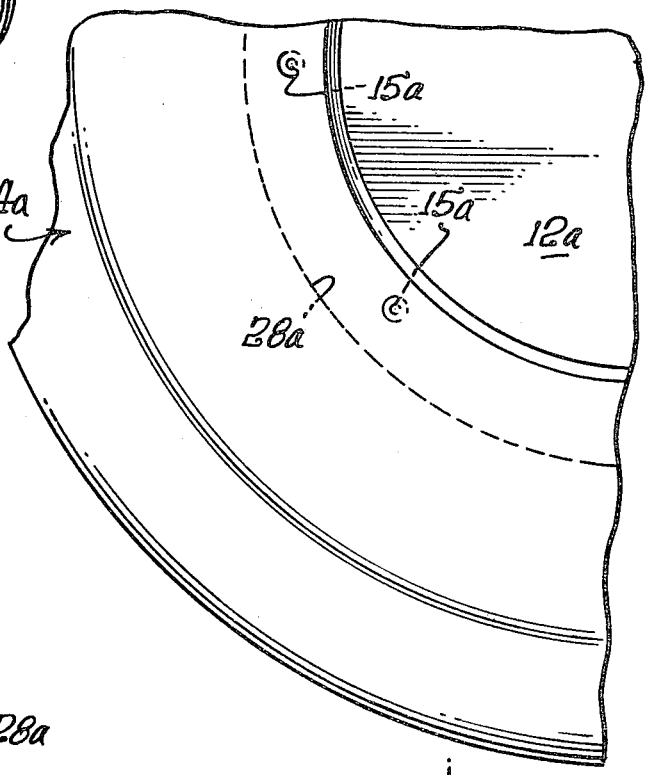
FIG. 6.
FIG. 7a.
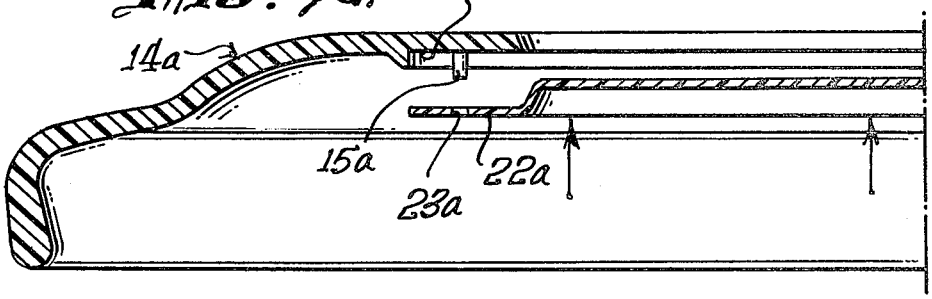
FIG. 7b.
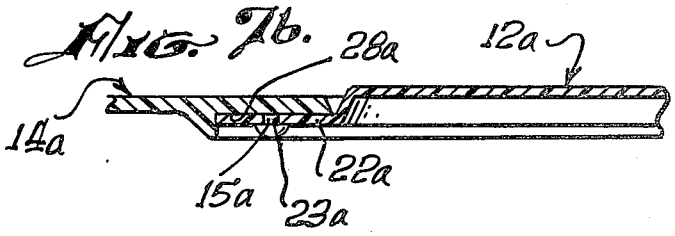

AERODYNAMIC THROWING DISC

This is a continuation, of application Ser. No. 745,871, filed Nov. 29, 1976, now abandoned.

BACKGROUND OF THE INVENTION

1. Field of the Invention

This invention relates generally to toys or sporting devices, and more particularly to an improved aerodynamic throwing disc of the kind commonly referred to as a flying saucer, toss toy, or Frisbee.

2. Prior Art

Aerodynamic discs of the kind to which this invention pertains are well known and have been widely used for a number of years as toys or sports devices by both children and adults. Accordingly, it is unnecessary to describe in elaborate detail either the construction or the aerodynamic theory of such a disc.

Suffice it to say that a conventional aerodynamic throwing disc comprises a relatively thin walled disc-like body of inverted, generally saucer shape having a normally upper circular central wall portion bounded about its perimeter by an annular rim portion whose outer perimeter, in turn, curls downwardly to form a downturned lip about the body. The central wall portion, rim portion, and lip are shaped to provide the body with an aerodynamic airfoil profile, such that when the disc is flung through the air with a spinning motion, it sails or glides in a manner simulating the proverbial "flying saucer." The spinning motion of the disc gyroscopically stabilizes the latter in flight. The central wall portion of the disc is commonly imprinted and/or embossed with lettering designating the manufacturer, a coined name of the disc, or the like.

Examples of these existing aerodynamic discs are shown in U.S. Pat. Nos. 3,359,678 and 3,724,122.

The existing aerodynamic discs of which I am aware have one deficiency with which the present invention is concerned. This deficiency resides in the fact that the entire disc body including its central wall portion, rim portion, and curled outer lip are injection molded in one piece from plastic. This one piece construction complicates the molding process and requires a central wall portion of about the same thickness as the rim portion. Moreover, it is difficult to imprint and/or emboss the central wall portion with the usual lettering, at least precisely formed lettering.

SUMMARY OF THE INVENTION

This invention provides an improved aerodynamic disc of the character described which avoids the above noted and other deficiencies of the existing discs and possess superior flight characteristics as well as superior gyroscopic stability.

According to the invention, the central wall portion and the rim portion of the aerodynamic disc are molded separately and then joined to one another. This method of disc fabrication provides two important advantages.

First, the central wall portion may be made relatively thin and thus may be conveniently and accurately imprinted and/or embossed with words, designs, or the like in a manner which yields superior characters. Secondly, the finished disc, may be provided with superior gyroscopic stability by appropriately sizing the rim portion in thickness relative to the central wall portion such that the disc possesses an enhanced "fly wheel" action.

The inner wall portion and outer rim portion may be joined in any convenient way. Two methods of joindure are described. According to one method, the wall and rim portions are heat sealed to one another. These portions might also be adhesively bonded together. According to the second described joining technique, the outer rim portion has integral pins which project through holes in the central wall portion and are thermally upset to secure the wall portion in place.

BRIEF DESCRIPTION OF THE DRAWINGS

FIG. 1 is a perspective view of an aerodynamic disc according to the invention;

FIG. 2 is an exploded perspective view of the disc on reduced scale;

FIG. 3 is an enlarged fragmentary face view of the disc;

FIGS. 4*a* and 4*b* are reduced fragmentary sections through the disc, illustrating the manner of joining its central wall and rim portions;

FIG. 5 is an exploded perspective view on a reduced scale of a modified form of an aerodynamic disc according to the invention;

FIG. 6 is an enlarged fragmentary face view of the disc of FIG. 5; and

FIGS. 7*a* and 7*b* are views similar to the views of FIGS. 4*a* and 4*b*, illustrating the modified method of joining the disc rim and central wall portion to form the disc of FIGS. 5 and 6.

DESCRIPTION OF THE PREFERRED EMBODIMENT

Referring first to FIGS. 1–4*b* of these drawings, reference numeral 10 denotes an aerodynamic disc or flying saucer according to the invention. This disc has a molded plastic body of inverted generally saucer-like shape including a central normally upper circular wall portion 12 bounded about its perimeter by an annular rim portion 14. The outer perimeter of the rim portion 14 curls downwardly relative to the central wall portion 12 to form a lip 16 about the rim portion. The body of the disc 10 has an aerodynamic or airfoil shape such that when the disc is thrown edgewise through the air with a spinning motion, it glides or sails in the usual "flying saucer-like" fashion.

The primary contribution of the present invention resides in a unique two piece construction of the disc 10. Thus, the central wall portion 12 and rim portion 14 of the aerodynamic disc 10 are separate molded pieces which are joined in the manner described below to form the unitary aerodynamic disc body. In the particular inventive embodiment illustrated, (FIGS. 1–4*b*), the central wall portion 12 is a relatively thin walled insert of shallow inverted dish-like shape having an upper wall 18, perimetrically bounded by a depending generally cylindrical side wall 20 and an outwardly directed flange 22 about the lower end of the side wall. The upper insert wall has lettering 24 which may be imprinted and/or embossed on the wall. As noted earlier, an advantage of the present two piece aerodynamic disc resides in the fact that the lettering 24 may be more easily and precisely formed on the insert 12 than on the integral central wall portion of a conventional aerodynamic disc because of the thin sheet form of the insert. Thus the insert may be fabricated by heat forming thin plastic sheet stock over a suitably shaped mold having lettering for embossing the lettering 24 in the insert.

The rim portion 14 of the disc 10 is an annulus whose outer perimeter is curled to form the lip 16. Extending through the center of the rim portion is an opening 26 for receiving the central disc insert 12. As shown best in FIGS. 4*a* and 4*b*, the normally underside of the rim portion is recessed about the opening 26 to form a shallow annular seat 28 surrounding the opening.

The insert 12 and the opening 26 and seat 28 of the rim portion 14 are relatively sized so that the insert fits snugly within the opening in the manner shown in FIGS. 4*a* and 4*b*. Thus, when assembled, the central inverted dish portion of the insert projects through the rim opening 26 and the insert flange 22 engages the rim seat 28.

As noted earlier, the insert 12 and rim portion 14 may be joined in any convenient way. For example, the rim portion and insert flange 22 may be clamped between annular heating bars 30, as shown in FIGS. 1–4*b*, to effect heat sealing of the flange to the rim portion. Alternatively, the insert flange may be adhesively bonded to the rim portion.

FIGS. 5 through 7*a* and 7*b* illustrate a modified form of an aerodynamic disc according to the invention wherein another method is utilized in joining the disc insert to the disc rim portion. In this case, the rim portion 14*a* has integrally molded studs or pins 15*a* projecting from its annular seat 28*a* at positions spaced about the seat. The flange 22*a* of the insert 12*a* has holes 23*a* through which the pins 15*a* project when the insert is assembled on the rim portion. After this assembly of the insert 12*a* on the rim portion 14*a*, the pins 15*a* are upset or headed, as shown in FIG. 5*b*, by the application of heat and pressure to join the insert to the rim portion.

The inventor claims:

1. An aerodynamic throwing disc comprising:

a relatively thin walled annular rim having a circular central opening, a radially outer edge portion which curls toward one side of the rim to define a circumferential lip about the rim, and an annular shoulder at said one side of said rim concentric with and spaced outwardly from the edge of said opening to define an annular seat about the opening, a circular insert element of uniform thickness thinner than said rim, said insert having an outer radially extending flat annular flange configurated to seat against the annular seat of the rim, and having a raised central portion spaced from the flange by an axially extending side wall, said central portion extending into said opening with its flange engaging the annular seat, and bearing indicia on its surface opposite from said rim annular seat, and means joining said insert flange to said rim portion.

2. An aerodynamic throwing disc according to claim 1 wherein:

said insert and rim portion comprise plastic materials, and said insert flange is heat sealed to said rim portion.

3. An aerodynamic throwing disc according to claim 1 wherein:

said joining means comprise headed pins on said rim portion about said opening projecting through holes in said insert flange.

4. An aerodynamic throwing disc according to claim 1 wherein:

said insert central portion indicia are applied prior to the joining of the insert to the rim portion.

* * * * *